US005968103A

United States Patent [19]

Rocke

[11] Patent Number: 5,968,103

[45] Date of Patent: Oct. 19, 1999

[54] SYSTEM AND METHOD FOR AUTOMATIC BUCKET LOADING USING CROWD FACTORS

[75] Inventor: David J. Rocke, Eureka, Ill.

[73] Assignee: Caterpillar Inc., Peoria, Ill.

[21] Appl. No.: 08/779,262

[22] Filed: Jan. 6, 1997

[51] Int. Cl.[6] ..... G06F 7/70; G06F 19/00

[52] U.S. Cl. ..... 701/50; 172/4.5; 37/348

[58] Field of Search ..... 701/50, 49; 172/4.5, 172/9; 37/347–348

[56] References Cited

U.S. PATENT DOCUMENTS

| | | | |
|---|---|---|---|
| 3,782,572 | 1/1974 | Gautier | 214/762 |
| 4,518,044 | 5/1985 | Wiegardt et al. | 701/50 |
| 5,065,326 | 11/1991 | Sahm | 364/424.07 |
| 5,404,661 | 4/1995 | Sahm et al. | 37/348 |
| 5,438,771 | 8/1995 | Sahm et al. | 37/348 |
| 5,446,980 | 9/1995 | Rocke | 37/348 |
| 5,461,803 | 10/1995 | Rocke | 37/443 |
| 5,493,798 | 2/1996 | Rocke et al. | 37/348 |
| 5,528,843 | 6/1996 | Rocke | 37/348 |
| 5,720,358 | 2/1998 | Christensen et al. | 701/54 |

OTHER PUBLICATIONS

PCT Application—WO 95/33896 Sensor Feedback Control for Automated Bucket Loading.

*Primary Examiner*—William A. Cuchlinski, Jr.
*Assistant Examiner*—Gertrude Arthur
*Attorney, Agent, or Firm*—Steven G. Kibby; Marla L. Hudson

[57] ABSTRACT

An electrohydraulic control system for loading a bucket of an earthmoving machine includes sensors for producing machine parameter signals representative of how strongly the machine is crowding the pile of material to be loaded. A command signal generator monitors crowd factors corresponding to the sensed parameters to determine when the bucket contacts the pile, then generates bucket lift hydraulic cylinder command signals to maintain a traction force. The command signal generator next determines from the crowd factors when the pile is engaged near the machine capacity, then generates bucket tilt hydraulic cylinder command signals in proportion to the monitored crowd factors to rack the bucket at rates calculated to efficiently capture the material.

19 Claims, 5 Drawing Sheets

SYSTEM AND METHOD FOR AUTOMATIC BUCKET LOADING USING CROWD FACTORS

TECHNICAL FIELD

This invention relates generally to a control system for automatically controlling a work implement of an earthworking machine and, more particularly, to an electrohydraulic system that controls the hydraulic cylinders of an earthworking machine to utilize crowd factors when capturing material.

BACKGROUND ART

Work machines for moving mass quantities of earth, rock, minerals and other material typically comprise a work implement configured for loading, such as a bucket controllably actuated by at least one lift and one tilt hydraulic cylinder. An operator manipulates the work implement to perform a sequence of distinct functions. In a typical work cycle for loading a bucket, the operator first maneuvers close to a pile of material and levels the bucket near the ground surface, then directs the machine forward to engage the pile.

The operator subsequently raises the bucket through the pile, while at the same time "racking" (tilting back) the bucket in order to capture the material. When the bucket is filled or breaks free of the pile, the operator fully racks the bucket and lifts it to a dumping height, backing away from the pile to travel to a specified dump location. After dumping the load, the work machine is returned to the pile to begin another work cycle.

It is increasingly desirable to automate the work cycle to decrease operator fatigue, to more efficiently load the bucket, and where conditions are unsuitable for a human operator. Conventional automated loading cycles however, where predetermined position or velocity command signals are sequentially supplied, may be inefficient and fail to fully load the bucket due to the wide variation in material conditions. Even when capturing a relatively homogenous material such as loose dirt, rock or other aggregates, when a predetermined racking velocity command is supplied the bucket may prematurely break free of the pile or dig in so deeply as to exceed the capabilities of the hydraulic system alone to break the bucket free.

U.S. Pat. No. 3,782,572 to Gautler discloses a hydraulic control system which controls a lift cylinder to maintain wheel contact with the ground, by monitoring associated wheel torque. U.S Pat. No. 5,528,843 to Rocke discloses a control system for capturing material which selectively supplies maximum lift and tilt signals in response to sensed hydraulic pressures. International Application No. WO 95/33896 to Daysys et al. discloses reversing the direction of fluid flow to the hydraulic cylinder when bucket forces exceed allowable limits. None of the systems however, variably control the magnitude of the command signals in order to more efficiently capture material.

The present invention is directed to overcoming one or more of the problems as set forth above.

DISCLOSURE OF THE INVENTION

Accordingly, it is an object of the present invention to provide automated loading by a work implement.

It is another object to provide signals for controlling a bucket to capture material, particularly aggregate.

It is still another object to provide an automated work cycle for an implement which increases productivity over a manual loading operation.

These and other objects may be achieved with an automatic control system constructed according to the principles of the present invention for loading material using a work implement in accordance with a crowd factor. In one aspect of the present invention, the system includes sensors that produce signals representative of machine parameters associated with loading the bucket of a wheel loader. A command signal generator receives the signals, determines a crowd factor, and responsively produces lift and tilt hydraulic cylinder command signals. At least the tilt command signal is produced in proportion to the crowd factor. Finally, an implement controller receives the lift command signals and controllably extends the lift cylinder to raise the bucket through the material, and receives the tilt command signals and controllably moves the tilt cylinder to tilt the bucket to capture the material.

Other details, objects and advantages of the invention will become apparent as certain present embodiments thereof and certain present preferred methods of practicing the same proceeds.

BRIEF DESCRIPTION OF THE DRAWINGS

A more complete appreciation of this invention may be had by reference to the following detailed description when considered in conjunction with the accompanying drawings in which like reference symbols indicate the same or similar components, wherein.

BEST MODE FOR CARRYING OUT THE INVENTION

Figure 1:
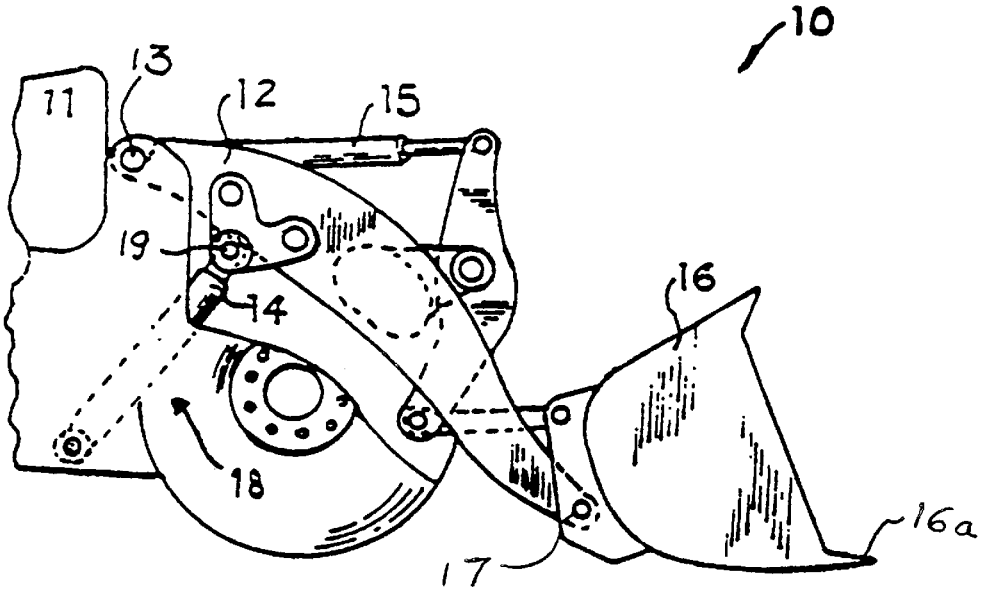
FIG. 1 schematically illustrates a wheel loader and corresponding bucket linkage.

Turning now to the drawings and referring first to FIG. 1, a forward portion of a wheel-type loader machine 10 is shown having a work implement comprising bucket 16 connected to a lift arm assembly 12 and having a bucket tip 16*a*. The lift arm assembly 12 is pivotally actuated by hydraulic lift cylinder 14 about lift arm pivot pins 13 attached to the machine frame 11. Lift arm load bearing pivot pins 19 are attached to the lift arm assembly 12 and the lift cylinder 14. The bucket 16 is tilted back or "racked" by a bucket tilt hydraulic cylinder 15 about bucket pivot pins 17. Although illustrated with respect to a loader moveable by wheels 18, the present invention is equally applicable to other machines such as track-type loaders and other work implements for capturing material.

Figure 2:
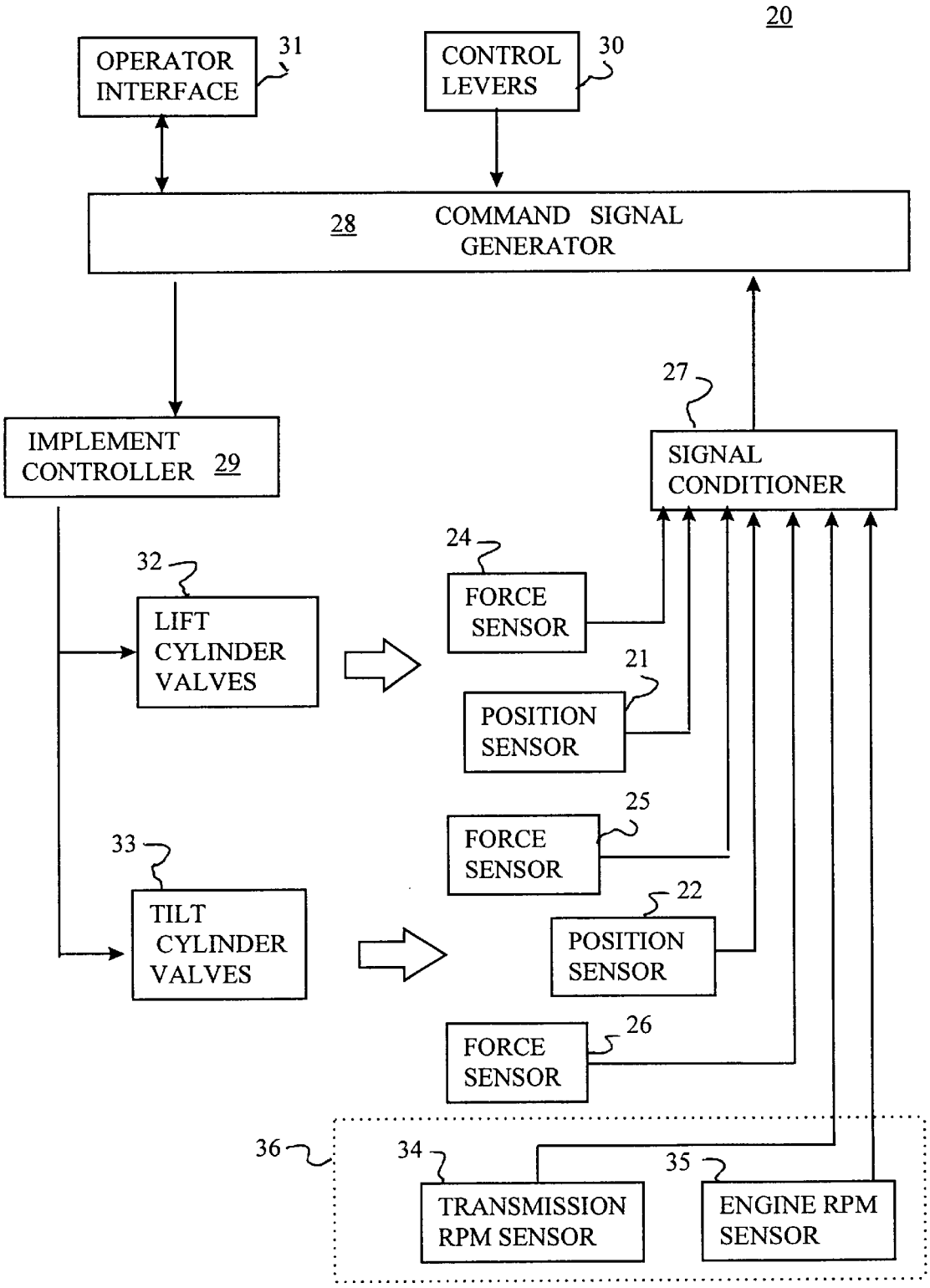
FIG. 2 shows a block diagram of an electrohydraulic system used to automatically control the bucket linkage.

FIG. 2 is a block diagram of an electrohydraulic control system 20 according to one embodiment of the present invention. Lift and tilt position sensors 21,22, respectively, produce position signals in response to the position of the bucket 16 relative to the frame 11 by sensing the piston rod extension of the lift and tilt hydraulic cylinders 14,15 respectively. Radio frequency resonance sensors such as those disclosed in U.S. Pat. No. 4,737,705 to Bitar et al. may be used for this purpose, or alternatively the position can be directly derived from work implement joint angle measurements using rotary potentiometers, yo-yos or the like to measure rotation at pivot pins 13 and 17.

Force sensors 24,25 and 26 produce signals representative of the hydraulic forces exerted on the bucket 16, preferably by sensing the pressures in the lift and alternatively in the tilt hydraulic cylinders. The lift cylinder is not retracted during loading, therefore a sensor is provided only at the head end of the cylinder, which is typically oriented to provide upward movement. Sensors may be provided at both head and rod ends of the tilt cylinder however, in order to permit force determinations during both racking and unracking of the bucket when appropriate to a particular control strategy. The pressure signals may be converted to corresponding force values through multiplication by a gain factor representative of the respective cross-sectional areas A of the piston ends. The representative tilt cylinder force FT corresponds to the difference between the product of the head end pressure and area and the product of the rod end pressure and area:

$$F_T = P_H * A_H - P_R * A_R$$

In an alternative embodiment, load cells or similar devices located at joints on the work implement may be utilized as force sensors 24, 26.

Torque converter output torque T supplied to wheels 18 is a function of the torque converter input and output shaft speeds, typically being sensed at the engine and drive train on either the transmission, axle or torque converter output shaft. Transmission speed and gear, and engine speed, can readily be monitored from a transmission controller 36 using passive pickups 34,35 producing electrical signals representative of rotational frequency, such as from passing gear teeth. A torque converter performance table unique to the specific torque converter design tabulates converter output torque for given torque converter input and output speeds.

On the assumption that the present invention substantially prevents wheel slip, machine ground speed S is similarly determined as a function of sensed transmission, torque converter output shaft or axle speed, with appropriate compensation for transmission or other gear reductions inherent in the drive train.

The position, force and speed signals may be delivered to a signal conditioner 27 for conventional signal excitation and filtering, but are then provided to the command signal generator 28. The command signal generator 28 is preferably a microprocessor-based system which utilizes arithmetic units to generate signals mimicking those produced by joystick control levers 30 according to software programs stored in memory. By mimicking command signals representative of desired lift/tilt cylinder movement direction and velocity conventionally provided by control levers 30, the present invention can be advantageously retrofit to existing machines by connection to implement controller 29 in parallel with, or intercepting, the manual control lever inputs. Alternatively, an integrated electrohydraulic controller may be provided by combining command signal generator 28 and a programmable implement controller 29 in to a single unit in order to reduce the number of components. A machine operator may optionally enter control specifications, such as material condition settings discussed hereinafter, through an operator interface 31 such as an alphanumeric key pad, dials, switches, or a touch sensitive display screen.

The implement controller 29 includes hydraulic circuits having lift and tilt cylinder control valves 32,33 for controlling the rate at which pressurized hydraulic fluid flows to respective lift and tilt hydraulic cylinders in proportion to received velocity command signals, in a manner well known to those skilled in the art. Lift and tilt hydraulic cylinder velocity command signals are for brevity referred to hereinafter as lift or tilt commands or command signals.

In operation, the command signal generator 28 controls bucket movement using crowd factors to proportionally modify command signals. A work machine such as a wheel loader is driven toward the pile of material to be loaded with the bottom of the bucket nearly level and close to the ground. After the bucket tip contacts and begins digging into the pile, command signals are generated to lift and rack the bucket through the material while the machine continues to be driven forward on wheels 18, referred to herein as "crowding" the pile. Various machine parameters may be monitored to determine the degree of crowding, which parameters are generally referred to herein as crowd factors. Such parameters may include, but are not limited to, hydraulic cylinder pressure or bucket force F, machine drive line torque T, accumulated energy E, engine speed and ground speed, which respectively increase or decrease as a result of resistance encountered by the bucket 16. The present invention preferably normalizes machine parameters to a percentage of a maximum value for a given machine model to generate crowd factors.

Figure 3:
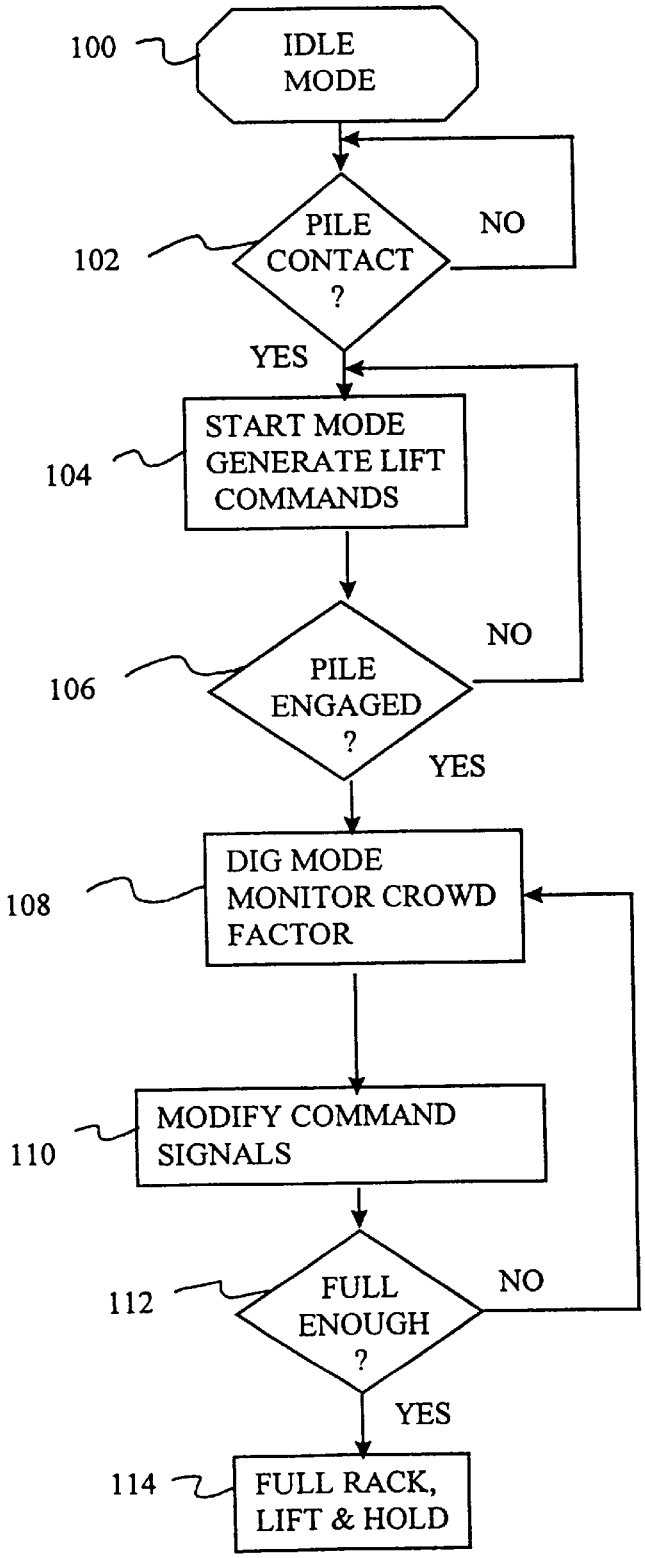
FIG. 3 is a flowchart of program control to automatically capture material.

FIG. 3 is a flow chart of a present preferred embodiment of the invention which may be implemented in program logic performed by command signal generator 28. In the description of the flowchart, the functional explanation marked with numerals in angle brackets, <nnn>, refers to blocks bearing that number.

The program control initially begins at a step <100> when a MODE variable is set to IDLE. MODE will be set to IDLE in response to the operator actuating a switch for enabling automated bucket loading control. Although program control is in an IDLE MODE, command signals will not be automatically generated if the operator has not substantially leveled the bucket near the ground surface. A bucket position derived from lift and tilt cylinder or pivot pin position signals may be used to determine whether the bucket floor is substantially level and near ground, such as within plus or minus ten degrees of horizontal at below 12% lift height. Additional sensed values which may be monitored to ensure that automatic bucket loading is not engaged accidentally or under unsafe conditions include:

Machine speed within a specified range, such as between one third top first gear speed and top second gear speed.

Control levers 30 substantially in a centered, neutral position, (a slight downward command may be allowed to permit floor cleaning).

Transmission shift lever in a low forward gear, eg. first through third, and at least a predetermined time has elapsed since the last upshift.

The operator then directs the machine into the pile of material, preferably at close to full throttle by the time the pile is fully engaged, while the program control monitors a crowd factor, such as torque T or lift cylinder force $F_L$, to determine when the machine has contacted the pile <102>. In a preferred embodiment, MODE is set to START <104> when command signal generator 28 determines that a torque crowd factor has exceeded a set point A and continues to increase. Additional parameters may be monitored as a cross check, such as whether machine ground speed is simultaneously decreasing or whether the crowd factor continues to increase for a predetermined duration. Such a cross check ensures, for example, that increased torque is not interpreted incorrectly as a pile contact when in fact it is caused by acceleration of the machine.

Once in the START MODE, command signal generator 28 optionally sends a downshift command to a transmission controller to cause the transmission to be placed in a lower gear by an automatic downshift routine (not shown), in order to match machine characteristics to a selected aggressiveness or material condition. Some materials may be loaded while remaining in a higher gear, by appropriately shifting the set points used to determine appropriate command signals. Reducing the transmission to the lowest gear upon contacting the pile however, permits the operator to quickly travel between loading and dumping locations while at the same time automatically ensuring maximum torque is available to crowd the pile.

In the START MODE <104>, a command signal is initially generated in order to cause the implement controller 29 to extend the lift cylinder using a preset velocity pattern and begin lifting the bucket through the pile, thereby quickly producing a downward force to load the wheels 18 and establish sufficient traction for the DIG portion of the work cycle. The preset velocity pattern may be a near maximum constant velocity, or even a time variant curve. The lift command signal is generated until the monitored crowd factor, or an additional crowd factor based upon sensed machine parameters, bypasses a set point B. The set point B represents a value at which the machine is close to its capacity, representing that the bucket has dug into and fully "engaged" the pile. For example, high torque or lift forces and very low ground speeds can predict when racking should begin to prevent a stall condition.

When the set point B is passed by the monitored crowd factor, MODE is set to DIG in step 108 and command signal generator 28 begins generating tilt command signals in proportion to a monitored crowd factor. At the same time, the maximum lift command signals are eliminated or reduced to a partial command velocity level.

Figure 4:
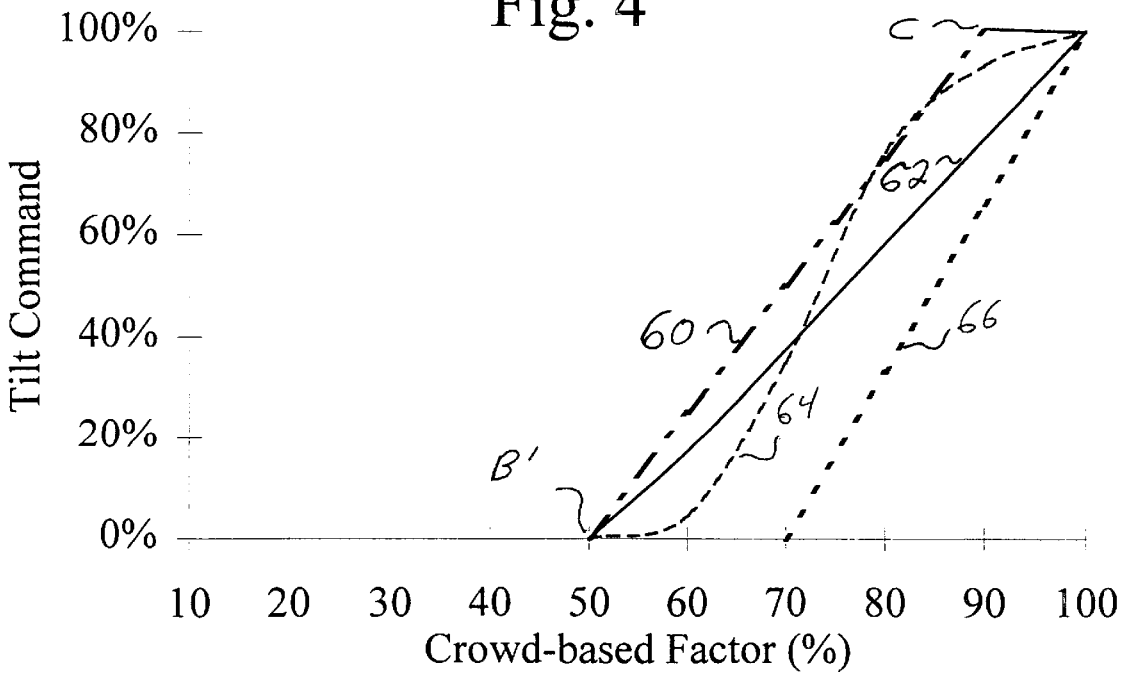
FIG. 4 is a schematic diagram illustrating a plurality of functions for relating crowd factors to tilt cylinder command signals.

With reference to FIG. 4, during the DIG MODE the command signal generator 28 produces tilt cylinder command signals $V_T$ on the basis of one or more predetermined racking functions 60,62,64,66 relating command signals to a monitored crowd factor Q. According to one embodiment of the present invention, the command signals $V_T$ increase linearly as a function of the crowd factor Q according to the relationship:

$$V_T=m\cdot Q+b$$

where m and b are respective constants selected based upon a material condition.

A racking function 62 having a slope m=2 for example, provides a slightly less aggressive approach than racking function 66 having a slope of m=1.43 if both intersect the crowd factor axis at the same location, because the command signal changes more rapidly in relation to changes in the crowd factor. The crowd factor axis intercept B' may correspond to the aforementioned set point B, indicating the pile is fully engaged, but is typically lower in order to continue crowd factor based racking over a wider range of values once it has begun.

Although the present invention has been described using a linear relationship between the command signals $V_T$ and crowd factor Q, it is apparent that a nonlinear racking function 64 may also be used, or the command signals may be increased by steps using a lookup table, without departing from the spirit of the present invention.

In operation, command signal generator 28 first determines a crowd factor Q, typically by normalizing sensed machine parameters as a percentage of a predetermined maximum value for the corresponding parameter. For example, a lift cylinder force crowd factor of 100% is defined as the pressure at which a pressure relief valve would open. As described hereinafter, crowd factors are preferably maintained by the present invention within their design limits to avoid stalling or damaging machine 10, or wasting hydraulic pump energy or permitting lift arm assembly 12 to sag in the case of lift cylinder force.

After determining at least one calculated crowd factor Q during the DIG MODE, command signal generator 28 consults a selected racking function to generate a corresponding proportional tilt command signal. A racking function 60 may include an upper break point C defining the limits of an envelope B'–C within which the command signal generator 28 works the crowd factor, either directly through the tilt command or indirectly such as through the lift command. In the former case, when a crowd factor Q exceeds break point C, the tilt command may remain constant until the crowd factor once again falls below the break point C. Regression analysis of the crowd factor may be used to predict developing trends, permitting early movement of the valve controlling the tilt cylinder to account for any lag time.

Although lifting and racking need not occur simultaneously, it is desirable to maintain a partial lift command during racking to ensure that sufficient force remains on the wheels to maintain traction and to avoid completely stopping the bucket if the tilt command is reduced to zero as described above. In a preferred embodiment, the lift command is reduced to a nominal value of about thirty percent when the DIG MODE begins. Typically, the implement controller 29 and associated valves have a "tilt priority", which diverts pressurized hydraulic fluid from the pump to meet the tilt command before supplying the tilt cylinder. Consequently, the lift cylinder may not extend at all during portions of t he work cycle where the tilt command exceeds some portion of maximum, despite a lift command having been generated. The lift command therefore typically only is effective when needed during the DIG MODE.

As mentioned previously, the monitored crowd factor Q, or a second crowd factor $Q_2$, may also be used to determine the lift command. For example, if lift force exceeds an upper set point D, the lift command may be temporarily reduced from thirty percent to zero percent.

The particular values utilized for the slope m and intercept b may be selectable by the operator in order to control the aggressiveness of the bucket loading, either individually or based upon a material condition setting input through switches on operator interface 31. The material condition may also be automatically determined, according to one embodiment, during a portion of the work cycle. For example, payload may be determined at the conclusion of a loading portion of the work cycle using sensed hydraulic pressures as an indication of loading efficiency to adjust the aggressiveness of the next work cycle.

After generating the lift and tilt velocity command signals, the command signal generator 28 determines in a step 112 whether the bucket is full enough to end the DIG MODE portion of the work cycle. If not, command signal generator 28 returns to step <108> to perform additional iterations of determined a crowd factor and command signals. If in step <112> the bucket 16 is determined to be full enough, then command signal generator 28 produces in step <114> command signals to cause the tilt cylinder to extend at maximum velocity, optionally followed by signals to extend the lift cylinder at maximum velocity to a given height up to the maximum extension. Command signal generator 28 determines in step <112> whether the bucket is full enough by comparing the lift and/or tilt cylinder extensions to set points including:

Whether the extension of the tilt cylinder is greater than a set point E, such as 0.75 radians, indicating that the bucket is almost completely racked back.

Whether the extension of the lift cylinder is greater than a set point F, indicating that the bucket has likely broken free of the pile.

Whether a loading time limit has been exceeded.

The operator may regain manual control over the bucket 16 at any time during the work cycle by moving either one of control levers 30 out of the neutral range to abort the program control. Otherwise, the bucket remains racked at full extension following completion of step <112> until the operator manually dumps the bucket 16 at a dump location or a subsequent automatic routine assumes control.

Industrial Applicability

Features and advantages associated the present invention are best illustrated by description of its operation in relation wheel loaders and using torque and lift force as representational crowd factors. Automatic bucket control is first initiated in response to monitored torque levels, and thereafter command signal generator 28 monitors drive line torque and lift force from sensed lift hydraulic cylinder pressure to determine when the bucket fully engages the pile. Once the pile is fully engaged, the command signal generator sends signals to the controller 29 to continuously vary the tilt command in response to a monitored crowd factor.

As described, the command signal generator 28 varies the lift and tilt cylinder command signals supplied to the controller within certain maximum values in order to maintain the monitored crowd factor within a given envelope.

Figure 5:
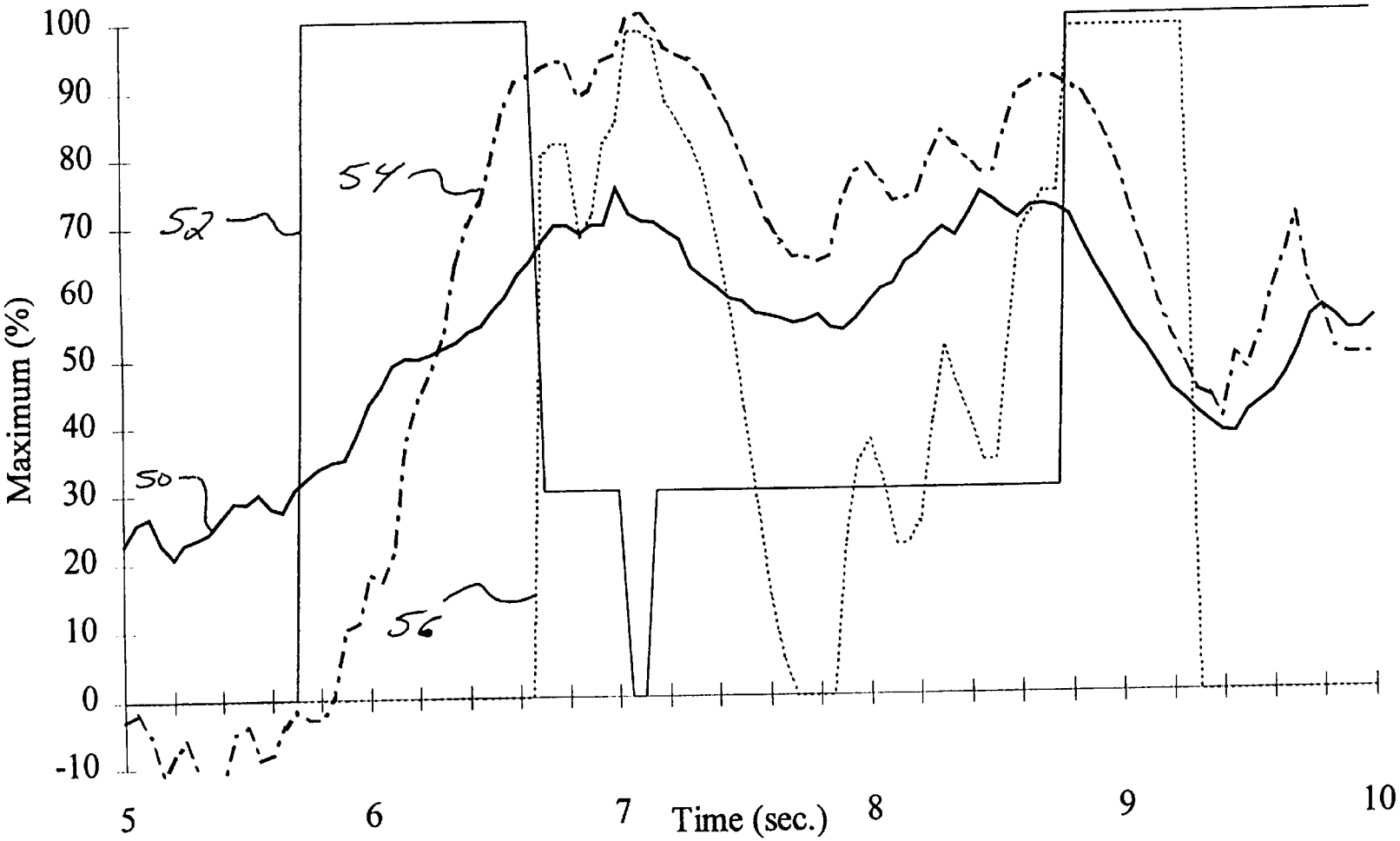
FIG. 5 is a graph illustrating a relationship between sensed and controlled values during a loading cycle.

FIG. 5 illustrates changes which may occur in a plurality of monitored and controlled parameters for a machine operating according to one embodiment of the present invention. Referring to FIGS. 3 and 5, the first five seconds represent only data recorded while in the IDLE MODE <100> and are therefor not shown. A START MODE begins at time 5.7 seconds, when a first crowd factor representing torque 50 exceeds a set point of thirty percent maximum and has been increasing at the same time ground speed (not shown) is decreasing, indicating the pile has been contacted <102>. A preset velocity pattern such as a maximum (100%) lift command 52 is then maintained <104> until at approximately 6.65 seconds the first monitored crowd factor 50 exceeds a second set point of sixty-five percent, indicating the pile is fully engaged <106> and the DIG MODE should begin.

In the DIG MODE, the lift command 52 is reduced to a partial thirty percent lift command, and a tilt commands 56 proportional to the second crowd factor 54 are iteratively generated <108>, <110>. Lift command 56 is temporarily reduced to zero at seven seconds when the second crowd factor 54 (lift force) exceeds its envelope at one hundred percent, but is returned to the partial thirty percent command shortly thereafter when lift force once again drops off. Tilt command 56 continues to be generated as a function of the second crowd factor representing lift force 54, falling to zero when the crowd factor 54 falls below a lower set point of sixty five percent, until at approximately 8.8 seconds the bucket is determined to be full enough <112>, and maximum lift and tilt commands are simultaneously generated. As demonstrated in the foregoing example, one or more crowd factors may be monitored to identify a DIG portion of the work cycle, and to independently or in combination drive generation of proportional lift and tilt commands.

Figure 6:
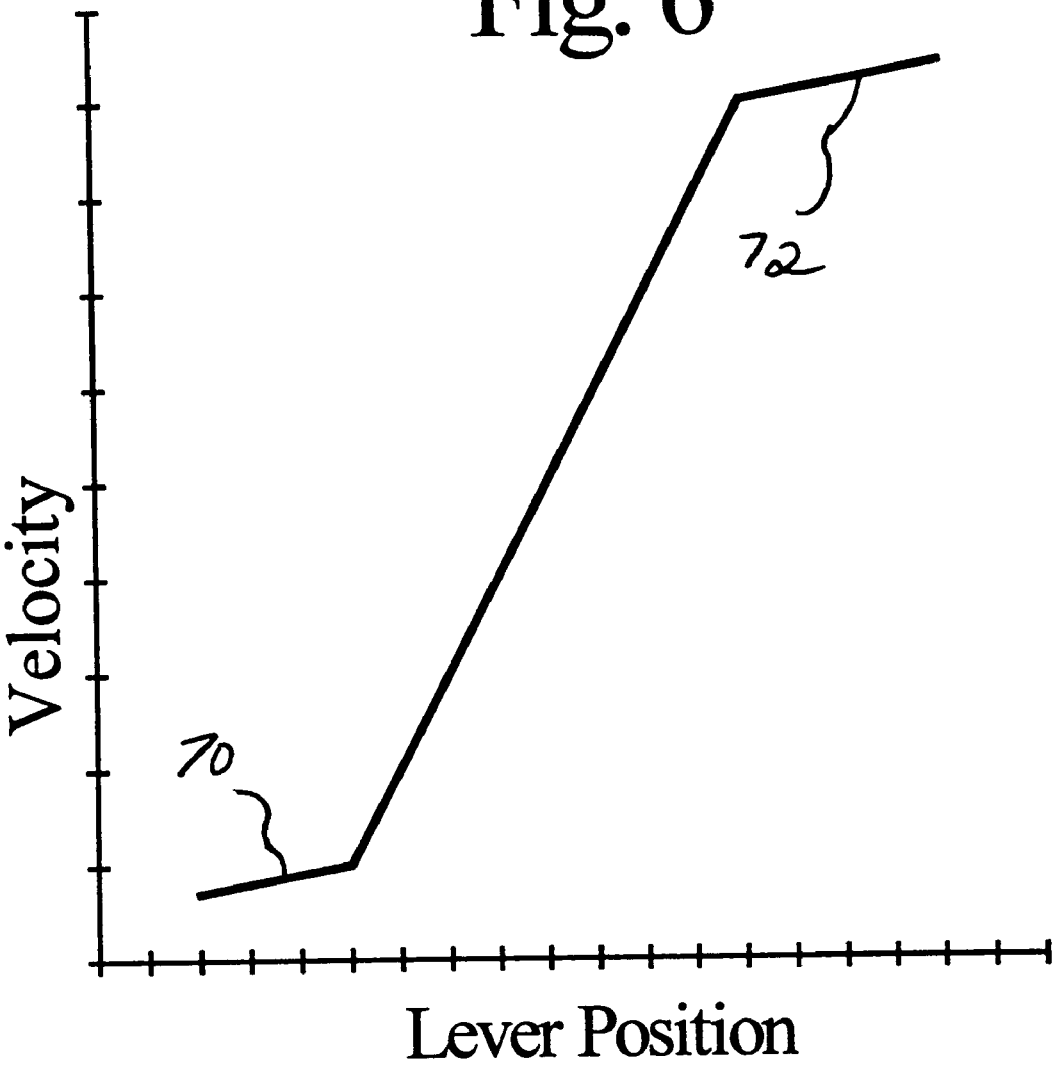
FIG. 6 is a graph illustrating a non-linear velocity response typically found within the range of manual control signals.

FIG. 6 illustrates a non-linear velocity response of implement controller 29 and hydraulic cylinders 14, 15 at the end positions 70,72 of control levers 30. Under manual control, this non-linearity is of little consequence because the operator typically is able to distinguish and react to only gross changes in velocity. In the present invention however, it is desirable to be able to make relatively small, accurate changes to hydraulic cylinder velocity in order to permit racking functions to be generated having a predictable response. Accordingly, in another aspect of the present invention, implement controller 29 is provided with closed loop control or factory calibration to ensure lift and tilt cylinder response is predictably proportional to velocity commands generated by command signal generator 28.

While certain present preferred embodiments of the invention and certain present preferred methods of practicing the same have been illustrated and described herein, it is to be distinctly understood that the invention is not limited thereto but may be otherwise variously embodied and practiced within the scope of the following claims.

What is claimed is:

1. A control system for automatically controlling a bucket of an earthmoving machine to capture material, the bucket being controllably actuated by a hydraulic tilt cylinder and lift cylinder, the system comprising:

sensing means for sensing machine parameters representing resistance to bucket movement through a material pile and generating machine parameter signals;

command signal generating means for receiving said machine parameter signals, responsively determining crowd factors corresponding to machine drive line torque, and generating tilt command signals in proportion to said crowd factors; and a hydraulic implement controller for modifying hydraulic fluid flow to said cylinders in response to said command signals.

2. A control system, as set forth in claim 1, said sensing means further comprising:

pressure sensors for producing pressure signals in response to hydraulic pressures associated with the lift cylinder, said command signal generating means determining said crowd factors using said lift cylinder pressures.

3. A control system as set forth in claim 1, further comprising:

means for selecting a material condition setting; and said command signal generating means computing said command signals as linear functions of said crowd factors, having a slope and intercept determined by said material condition setting.

4. A control system as set forth in claim 3, said means for selecting a material condition setting comprising at least one operator actuated switch.

5. A control system, as set forth in claim 1 said sensing means further comprising:

position sensing means for producing position signals representative of the respective extensions of the lift and tilt cylinders; and said command signal generating means comparing the position signals to a plurality of positional set points, and generating substantially maximum tilt cylinder velocity command signals to fully rack the bucket when the position of one of said lift and tilt cylinders exceed respective positional set points.

6. A control system for automatically controlling a bucket of an earthmoving machine to capture material, the bucket being controllably actuated by a hydraulic tilt cylinder and lift cylinder, said earthmoving machine including a drive line having a torque converter and transmission, the control system comprising:

sensing means for sensing machine parameters representing resistance to bucket movement through a material pile, said sensing means comprising speed sensors for producing speed signals representative of engine and drive line speeds;

command signal generating means for receiving the speed signals and determining crowd factors corresponding to torque converter output torque, and generating tilt command signals in response to said torque crowd factors; and a hydraulic implement controller for modifying hydraulic fluid flow to said cylinders in response to said command signals.

7. A control system, as set forth in claim 6, further comprising:

said command signal generating means determining when the bucket has contacted the pile using said torque crowd factors and responsively generating predetermined velocity pattern lift command signals to engage the pile.

8. A control system, as set forth in claim 7, further comprising:

said command signal generating means determining the bucket has fully engaged the pile when said torque crowd factors exceed a predetermined set point and continue to increase while machine speed is decreasing, as a condition for generating said tilt command signals in proportion to said crowd factors.

9. A control system, as set forth in claim 7, further comprising:

said command signal generating means generating a shift command signal to downshift the transmission to a lower gear after determining the bucket has contacted the pile.

10. A control system, as set forth in claim 9, further comprising:

said sensing means further comprising pressure sensors for producing pressure signals in response to hydraulic pressures associated with the lift cylinder; and said command signal generating means further determining crowd factors corresponding to lift forces associated with said lift cylinder pressures, reducing said maximum lift command to a partial lift command when said lift force crowd factors exceed a set point, and subsequently producing tilt command signals in proportion to said lift force crowd factors.

11. A method for automatically controlling a work implement of an earthworking machine to capture material, the work implement including an engine, a torque converter, a drive line and a bucket, the bucket being controllably actuated by a lift hydraulic cylinder and a tilt hydraulic cylinder, the method comprising the steps of:

producing signals representative of sensed hydraulic pressures in the lift hydraulic cylinder;

producing signals representative of engine and drive line speeds;

calculating torque converter output torque from said speed signals;

determining when the machine engages a pile of material by comparison of crowd factors corresponding to at least said torque converter output with first predetermined set points; and generating tilt commands as a function of said crowd factors, for controllably extending the tilt cylinder to tilt the bucket to capture the material.

12. A method, as set forth in claim 11, further comprising:

determining when the bucket contacts the pile of material by comparison of crowd factors corresponding to at least one of said torque, said pressure signals and said speed signals with second predetermined set points;

generating maximum lift commands for controllably extending the lift cylinder to raise the bucket through the material when the bucket contacts the pile of material, and reducing said maximum lift commands to partial lift commands when the machine is determined to have engaged the pile.

13. A control system as set forth in claim 11, further comprising:

selecting a material condition setting; and said step of generating said tilt commands as a function of said crowd factors further comprises selecting a linear function having a slope and intercept determined by said material condition setting.

14. A method for automatically controlling a work implement of an earthworking machine to capture material, the work implement including a bucket and a drive train, the drive train having an engine, a torque converter, a transmission, and rotatable members to move the bucket of the earthworking machine into a pile of the material, the bucket being controllably actuated by a lift hydraulic cylinder and a tilt hydraulic cylinder, the method comprising the steps of;

determining crowd factors corresponding to sensed machine parameters indicative of a degree to which the machine crowds the pile, said machine parameters including drive line torque;

generating tilt commands in proportion to said crowd factors corresponding to drive line torgue; and controllably extending the tilt cylinder to tilt the bucket to capture the material responsive to said tilt commands.

15. A method, as set forth in claim 14, further comprising:

producing signals representative of engine and drive line speeds;

calculating torque converter output torque from said speed signals, wherein said crowd factors correspond to said output torque;

determining when the bucket contacts the pile of material by comparison of said torque crowd factors with a first predetermined set point;

generating lift commands responsive to said bucket contact; and controllably extending the lift cylinder to lift the bucket responsive to said lift commands.

16. A method, as set forth in claim 14, further comprising:

determining when the machine fully engages the pile of material, wherein said tilt command are generated in proportion to said crowd factors only after the machine has been determined to have fully engaged the pile.

17. A method, as set forth in claim 14, further comprising:

determining when the machine engages the pile of material by comparison of said torque crowd factors with a second predetermined set point greater than said first set point and responsively generating partial lift commands.

18. A method, as set forth in claim 14, further comprising:

producing signals representative of hydraulic pressures in the lift cylinder, wherein said tilt commands are generated in proportion to a crowd factor corresponding to said lift pressures.

19. A method, as set forth in claim 14, further comprising:

selecting a material condition setting; and said step of generating said tilt commands in proportion to said crowd factors further comprises varying said proportional tilt commands along a slope and intercept determined by said material condition setting.

* * * * *